US008099978B2

(12) United States Patent
Aung et al.

(10) Patent No.: US 8,099,978 B2
(45) Date of Patent: Jan. 24, 2012

(54) EVAPORATOR UNIT

(75) Inventors: Thuya Aung, Okazaki (JP); Tomohiko Nakamura, Obu (JP); Yoshiyuki Okamoto, Nagoya (JP); Hideaki Sato, Anjo (JP); Nobuharu Kakehashi, Toyoake (JP)

(73) Assignee: Denso Corporation, Kariya (JP)

( * ) Notice: Subject to any disclaimer, the term of this patent is extended or adjusted under 35 U.S.C. 154(b) by 718 days.

(21) Appl. No.: 12/286,868

(22) Filed: Oct. 2, 2008

(65) Prior Publication Data

US 2009/0090130 A1 Apr. 9, 2009

(30) Foreign Application Priority Data

Oct. 3, 2007 (JP) ..... 2007-259642

(51) Int. Cl.
*F25B 39/02* (2006.01)

(52) U.S. Cl. ..... 62/515; 62/525

(58) Field of Classification Search ..... 62/525, 62/500, 196.1, 515, 434; 165/175, 149
See application file for complete search history.

(56) References Cited

U.S. PATENT DOCUMENTS

| | | | | |
|---|---|---|---|---|
| 5,183,103 | A * | 2/1993 | Tokutake | 165/67 |
| 7,059,150 | B2 * | 6/2006 | Komatsu et al. | 62/500 |
| 7,178,359 | B2 * | 2/2007 | Oshitani et al. | 62/500 |
| 7,219,511 | B2 | 5/2007 | Inaba et al. | |
| 7,886,812 | B2 * | 2/2011 | Higashiyama | 165/174 |
| 7,971,636 | B2 * | 7/2011 | Higashiyama et al. | 165/174 |
| 2006/0201198 | A1 | 9/2006 | Nishino et al. | |
| 2007/0000262 | A1 * | 1/2007 | Ikegami et al. | 62/170 |
| 2007/0039337 | A1 | 2/2007 | Nishijima et al. | |
| 2007/0163294 | A1 | 7/2007 | Aung | |
| 2007/0169512 | A1 | 7/2007 | Ishizaka et al. | |
| 2007/0277964 | A1 * | 12/2007 | Higashiyama et al. | 165/153 |
| 2007/0295026 | A1 | 12/2007 | Mori et al. | |
| 2008/0053137 | A1 | 3/2008 | Higashiyama | |
| 2008/0302131 | A1 * | 12/2008 | Higashiyama | 62/515 |

FOREIGN PATENT DOCUMENTS

JP 2004-144395 5/2004

(Continued)

OTHER PUBLICATIONS

Office action dated Jan. 8, 2010 in corresponding Chinese Application No. 2008 10161081.8.

(Continued)

*Primary Examiner* — Mohammad Ali

(74) *Attorney, Agent, or Firm* — Harness, Dickey & Pierce, PLC

(57) ABSTRACT

An evaporator unit includes a first heat exchanger configured to perform heat exchange between refrigerant flowing thereinto from a refrigerant inlet and air, a bypass passage through which the refrigerant flowing from the refrigerant inlet flows while bypassing the first heat exchanger, a second heat exchanger configured to perform heat exchange between air and mixed refrigerant in which the refrigerant after passing through the first heat exchanger and the refrigerant having passed through the bypass passage are mixed, and a flow amount adjustment portion configured to adjust a flow amount of the refrigerant flowing through the first heat exchanger and a flow amount of the refrigerant flowing through the bypass passage. Accordingly, the first heat exchanger and the second heat exchanger can be configured to have respectively portions in which a dryness of the refrigerant is in a range between 0.6 and 0.9.

12 Claims, 7 Drawing Sheets

FOREIGN PATENT DOCUMENTS

| | | |
|---|---|---|
| JP | 2005-055072 | 3/2005 |
| JP | 2005-083677 | 3/2005 |
| JP | 2006-38429 | 2/2006 |
| JP | 2006-105581 | 4/2006 |
| JP | 2006-132920 | 5/2006 |
| JP | 2006-250412 | 9/2006 |
| JP | 2007-051833 | 3/2007 |
| JP | 2007-147198 | 6/2007 |
| JP | 2007-192465 | 8/2007 |
| JP | 2007-192502 | 8/2007 |

OTHER PUBLICATIONS

Office action dated Aug. 18, 2009 in corresponding JP Application No. 2007-259642.

* cited by examiner

EVAPORATOR UNIT

CROSS REFERENCE TO RELATED APPLICATION

This application is based on Japanese Patent Application No. 2007-259642 filed on Oct. 3, 2007, the contents of which are incorporated herein by reference in its entirety.

FIELD OF THE INVENTION

The present invention relates to an evaporator unit including plural heat exchangers for a refrigeration cycle device.

BACKGROUND OF THE INVENTION

Conventionally, JP-A-2004-144395 discloses an evaporator unit that includes heat exchangers on the upstream and downstream air sides, and adapted to equalize the temperature distribution of air blown therefrom.

In the related art, refrigerant flowing through the evaporator unit is allowed to flow through the heat exchanger on the downstream air side and the heat exchanger on the upstream air side in series in that order without being branched and joined. Thus, as the refrigerant flows from the heat exchanger on the downstream air side toward the heat exchanger on the upstream air side, the evaporation of the refrigerant proceeds to increase the dryness of the refrigerant.

Generally, the dryness of refrigerant with a high heat exchange property is in a range between 0.6 and 0.9.

Since the dryness of refrigerant is increased as the refrigerant flows from the heat exchanger on the downstream air side to the heat exchanger on the upstream air side in the related art, the entire evaporator unit including a combination of the two heat exchangers on the upstream and downstream air sides has only one part thereof at which the dryness of refrigerant is in a range between 0.6 and 0.9.

SUMMARY OF THE INVENTION

In view of the foregoing problems, it is an object of the present invention to provide an evaporator unit including a plurality of portions at which the dryness of refrigerant is in a range between 0.6 and 0.9.

According to an aspect of the present invention, an evaporator unit includes a first heat exchanger configured to perform heat exchange between refrigerant flowing thereinto from a refrigerant inlet and air, a bypass passage through which the refrigerant flowing from the refrigerant inlet flows while bypassing the first heat exchanger, a second heat exchanger configured to perform heat exchange between air and mixed refrigerant in which the refrigerant after passing through the first heat exchanger and the refrigerant having passed through the bypass passage are mixed, and a flow amount adjustment portion configured to adjust a flow amount of the refrigerant flowing through the first heat exchanger and a flow amount of the refrigerant flowing through the bypass passage.

Because the mixed refrigerant, in which the refrigerant having a relatively large dryness after being heat-exchanged with air in the first heat exchanger and the refrigerant having relatively small dryness without passing through the first heat exchanger are mixed, flows into the second heat exchanger, the dryness of the refrigerant in an upstream portion of the second heat exchanger in the refrigerant flow can be made smaller than the dryness of the refrigerant in a downstream portion of the first heat exchanger in the refrigerant flow.

Furthermore, because the flow amount adjustment portion is configured to adjust the flow amount of the refrigerant flowing through the first heat exchanger and the flow amount of the refrigerant flowing through the bypass passage, it is possible for the evaporator unit to have a plurality of portions at which the dryness of refrigerant is in a range between 0.6 and 0.9. For example, each of the first heat exchanger and the second heat exchanger has the portion at which the dryness of refrigerant is in a range between 0.6 and 0.9. As a result, the heat exchanging performance can be effectively improved in the entire evaporator unit.

For example, the first heat exchanger is disposed on a downstream air side of the second heat exchanger in an air flow, and the second heat exchanger is disposed on an air upstream air side of the first heat exchanger in the air flow.

A downstream portion of the first heat exchanger on the most downstream side of the refrigerant flow and a downstream portion of the second heat exchanger on the most downstream side of the refrigerant flow are arranged at different positions so as not to be superimposed with each other when being viewed in a direction parallel to the air flow. Accordingly, it is possible to make the dryness of the refrigerant to be uniform.

As an example, a sectional area of a refrigerant flow path in the second heat exchanger may be set larger than that of a refrigerant flow path in the first heat exchanger.

The flow amount adjustment portion may include a fixed throttle. In this case, a diameter of the refrigerant flow path in the flow amount adjustment portion may be set to be equal to or less than 4 mm.

The evaporator unit may include a connection portion configured to have a branch portion between the refrigerant inlet and the bypass passage. In this case, the flow amount adjustment portion can be formed in the connection portion. Furthermore, the first heat exchanger, the second heat exchanger, and the connection portion may be integrally brazed together.

The first heat exchanger may include a plurality of tubes for allowing the refrigerant to flow therethrough, and a tank for distributing the refrigerant into the tubes and collecting the refrigerant from the tubes. In this case, the flow amount adjustment portion can be disposed in the tank.

An internal space of the tank can be partitioned into a distribution space for distributing the refrigerant into the tubes, and a collection space for collecting the refrigerant from the tubes. In this case, the first heat exchanger may have an outlet side configured to be in communication with an inlet side of the second heat exchanger via the collection space, and an introduction pipe may be located in the distribution space to introduce the refrigerant flowing through the bypass passage into the collection space. Furthermore, the flow amount adjustment portion may be integrated with the introduction pipe, and the tank and the introduction pipe may be integrally brazed to each other.

For example, the flow amount adjustment portion may include a first portion located between a branch portion of the bypass passage and a refrigerant inlet side of the first heat exchanger to adjust a flow amount of the refrigerant flowing into the first heat exchanger, and a second portion located in the bypass passage.

The evaporator unit may be further provided with a third heat exchanger located at an upstream or a downstream side of the second heat exchanger in a refrigerant flow. In this case, the first to third heat exchangers may be configured to have a plurality of portions in which the dryness of the refrigerant is in a range between 0.6 and 0.9. Furthermore, each of the first to third heat exchangers may have the portion in which the dryness of the refrigerant is in a range between 0.6 and 0.9.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS (First Embodiment)

Figure 1:
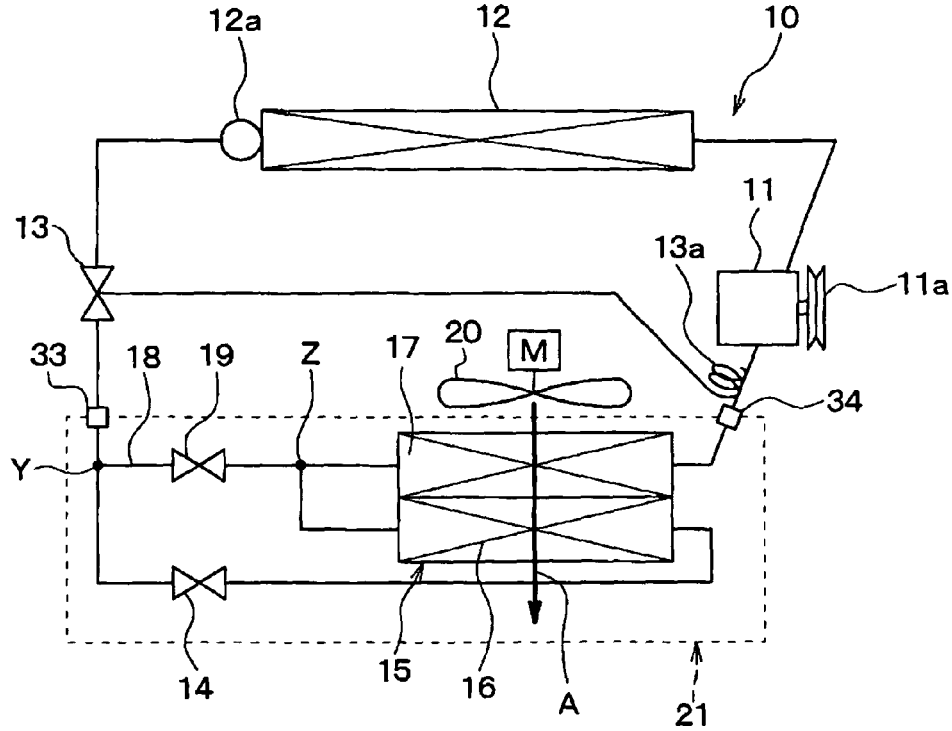
FIG. 1 is a refrigerant circuit diagram showing a refrigeration cycle device according to a first embodiment of the present invention.

A first embodiment of the invention will be described below with reference to FIGS. 1 to 4. FIG. 1 shows an example in which a refrigeration cycle device 10 of the first embodiment is typically used for a vehicle. In the refrigeration cycle device 10 of the present embodiment, a compressor 11 for sucking and compressing refrigerant is rotatably driven by an engine for vehicle running (not shown) via an electromagnetic clutch 11*a*, a belt, and the like.

As the compressor 11, may be used either a variable displacement compressor for being capable of adjusting a refrigerant discharge capacity by a change in discharge volume, or a fixed displacement compressor for adjusting a refrigerant discharge capacity by changing an operating efficiency of the compressor by intermittent connection of the electromagnetic clutch 11*a*. The use of an electric compressor as the compressor 11 can adjust the refrigerant discharge capacity by adjustment of the number of revolutions of an electric motor.

A refrigerant radiator 12 such as a gas cooler or a condenser is disposed on the refrigerant discharge side of the compressor 11. The radiator 12 exchanges heat between high-pressure refrigerant discharged from the compressor 11 and outside air (i.e., air outside a vehicle compartment) blown by a cooling fan (not shown) thereby to cool the high-pressure refrigerant.

In the present embodiment, the refrigerant whose high-pressure side pressure does not exceed the critical pressure, such as a flon-based or HC-based refrigerant, is used as the refrigerant for the refrigeration cycle device 10 to form a vapor-compression subcritical cycle. Thus, the radiator 12 serves as a condenser for condensing the refrigerant.

A liquid receiver 12*a* is provided on the outlet side of the radiator 12. The liquid receiver 12*a* has a vertically oriented tank-like shape as being well known, and serves as a gas-liquid separator for separating the refrigerant into gas and liquid phases to store therein the excess liquid refrigerant in the refrigerant cycle. The liquid refrigerant is guided to flow from a lower part of the inside of the tank shape at an outlet of the liquid receiver 12*a*. The liquid receiver 12*a* is integrally formed with the radiator 12 in the present embodiment.

The radiator 12 may be an integrated structure including a heat exchanging portion for condensation positioned on the upstream side of the refrigerant flow, the liquid receiver 12*a* for receiving the refrigerant introduced from the heat exchanging portion for condensation to separate the refrigerant into gas and liquid phases, and a heat exchanging portion for supercooling of the saturated liquid refrigerant from the liquid receiver 12*a*.

A thermal expansion valve 13 is disposed on a refrigerant outlet side of the liquid receiver 12*a*. The thermal expansion valve 13 serves as a decompression unit configured to decompress the liquid refrigerant from the liquid receiver 12*a*, and has a temperature sensing portion 13*a* located in a refrigerant passage on the suction side of the compressor 11.

The thermal expansion valve 13 is configured to detect a degree of superheat of the refrigerant on the suction side of the compressor 11 based on the temperature and pressure of the suction side refrigerant of the compressor 11. That is, the thermal expansion valve 13 is configured to detect a degree of superheat of the refrigerant on the suction side of the compressor 11 based on the temperature and pressure of refrigerant on the outlet side of an evaporator described later. The expansion valve 13 is configured to adjust a degree of opening of a valve (refrigerant flow amount) such that the degree of superheat of the refrigerant on the suction side of the compressor 11 approaches to a preset value, as is known generally.

A first flow amount adjustment portion 14 (flow amount adjustment mechanism) for adjusting a flow amount of refrigerant flowing into an evaporator 15 is disposed on a refrigerant outlet side of the thermal expansion valve 13. The first flow amount adjustment portion 14 as well as a second flow amount adjustment portion 19 (flow amount adjustment mechanism) to be described later correspond to a flow amount adjustment unit of the invention. The first flow amount adjustment portion 14 can be constructed of a fixed throttle, specifically, an orifice, or a capillary tube.

The evaporator 15 includes a first heat exchanger 16 and a second heat exchanger 17, and the refrigerant outlet side of the first flow amount adjustment portion 14 is connected to the refrigerant inlet side of the first heat exchanger 16. The refrigerant outlet side of the first heat exchanger 16 is connected to a refrigerant inlet side of the second heat exchanger 17, and the refrigerant outlet side of the second heat exchanger 17 is connected to the refrigerant suction side of the compressor 11.

On the other hand, a bypass passage 18 through which refrigerant bypasses the first heat exchanger 16 is branched from a branch portion between the outlet side of the thermal expansion valve 13 and the refrigerant inlet side of the first flow amount adjustment portion 14. The downstream side of the bypass passage 18 is connected to a join portion Z between the outlet side of the first heat exchanger 16 and the inlet side of the second heat exchanger 17. In FIG. 1, the bypass passage 18 through which the refrigerant bypasses the first heat exchanger 16 is branched from the branch portion Y, and is joined at the join portion Z, in the refrigerant cycle.

The second flow amount adjustment portion 19 serving as a flow amount adjustment mechanism is disposed in the bypass passage 18. The second flow amount adjustment portion 19 can be constructed of a fixed throttle, specifically, an orifice, or a capillary tube.

In the present embodiment, the evaporator 15 is accommodated in a case (not shown), and air is blown by an electric blower 20 in an air passage formed in the case in the direction indicated by the arrow "A". The air is cooled by the evaporator 15, and is blown into a space to be cooled.

The air cooled by the evaporator 15 is fed into the space to be cooled (e.g., vehicle compartment) thereby to cool the space to be cooled. The first heat exchanger 16 on the upstream refrigerant side of the evaporator 15 is disposed on the downstream side of the air flow "A" (on the downstream air side), and the second heat exchanger 17 on the downstream refrigerant side of the join portion Z is disposed on the upstream side of the air flow "A" (on the upstream air side).

When the refrigeration cycle device 10 of the present embodiment is applied to a vehicle air conditioning, a space inside the vehicle compartment is the space to be cooled. When the refrigeration cycle device 10 of the present embodiment is applied to a freezer car, a freezer and refrigerator space of the freezer car is the space to be cooled.

In the present embodiment, the evaporator 15, the first and second flow amount adjustment portions 14 and 19, and a connection portion such as a connection block 31 and an intervening plate 32 between a refrigerant passage to be described later are assembled as one integrated evaporator unit 21. Now, a specific example of the integrated evaporator unit 21 will be described below.

Figure 2:
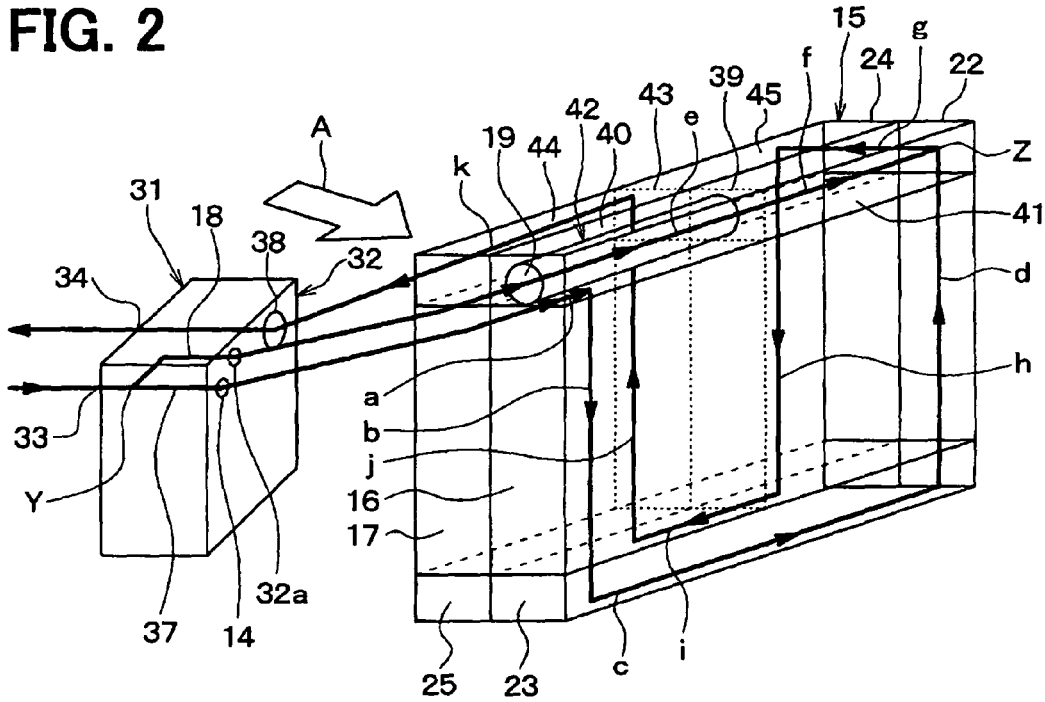
FIG. 2 is a disassembled schematic perspective view showing an integrated evaporator unit according to the first embodiment.
Figure 3:
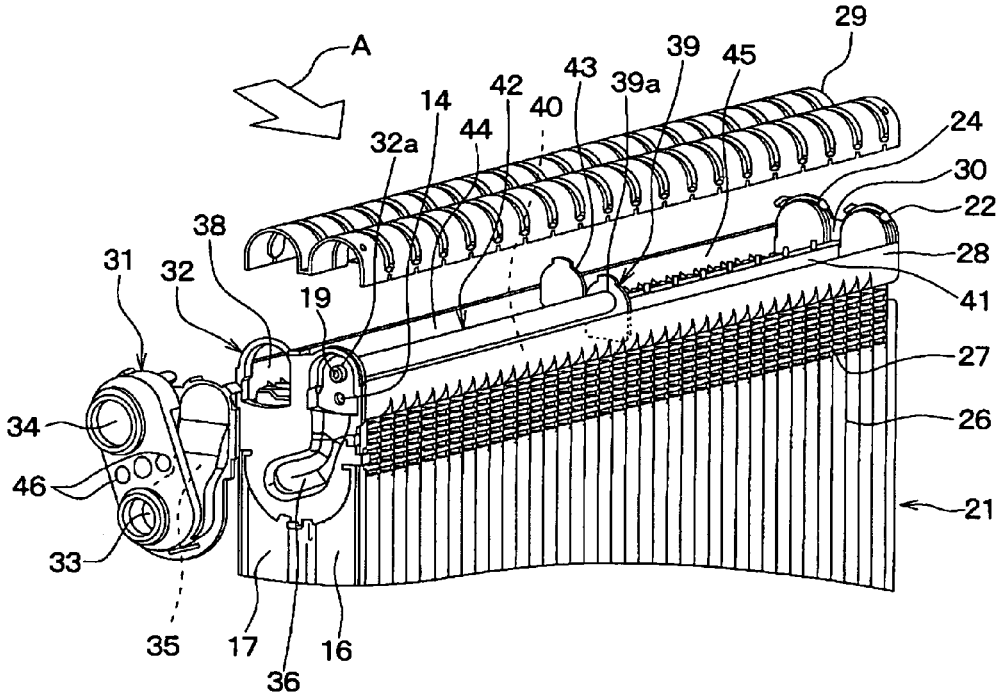
FIG. 3 is a disassembled perspective view showing a part of the integrated evaporator unit according to the first embodiment.

FIG. 2 is a schematic perspective view showing an entire configuration of the integrated evaporator unit 21, and FIG. 3 is an exploded perspective view showing a part of the integrated evaporator unit 21.

In the present embodiment, the evaporator 15 including the two heat exchangers 16 and 17 is formed completely as one evaporator structure. Thus, the first heat exchanger 16 constitutes an area of the one evaporator structure on a downstream side of the air flow "A", and the second heat exchanger 17 constitutes another area of the one evaporator structure on the upstream side of the air flow "A".

The evaporator 15 includes tanks 22 and 23 positioned on both upper and lower sides of the first heat exchanger 16, and tanks 24 and 25 positioned on both upper and lower sides of the second heat exchanger 17.

As shown in FIG. 3, the first and second heat exchangers 16 and 17 include a plurality of tubes 26 extending approximately vertically. An air passage through which air to be cooled passes is formed between the tubes 26. Fins 27 are disposed between the tubes 26, thereby enabling heat exchanging area between the tubes 26 and the fins 27.

Each of the first and second heat exchangers 16 and 17 is constructed of a lamination of the tubes 26 and the fins 27. The tubes 26 and the fins 27 are alternately laminated in the lateral direction of the first and second heat exchangers 16 and 17.

In the present embodiment, the laminated structure including the tubes 26 and the fins 27 is formed over each of the entire areas of the first and second heat exchangers 16 and 17. The blown air from the electric blower 20 passes through voids of the laminated structure. Alternatively, a laminated structure without fins 27 may be used in the evaporator 15.

The tube 26 constitutes therein a refrigerant passage, and is constructed of a flat tube having a flat sectional shape elongated along the air flow "A" direction. The fin 27 is a corrugated fin formed by bending a thin plate in a wave-like shape, and is connected to the flat outer surface of the tube 26 to enlarge an air-side heat transmission area.

The tubes 26 of the first heat exchanger 16 and the tubes 26 of the second heat exchanger 17 respectively construct the refrigerant passages that are independent from each other. The tanks 22 and 23 on both upper and lower sides of the first heat exchanger 16, and the tanks 24 and 25 on both upper and lower sides of the second heat exchanger 17 construct the refrigerant passage spaces that are independent from each other.

Both upper and lower tanks 22 and 23 of the first heat exchanger 16 and both upper and lower tanks 24 and 25 of the second heat exchanger 17 extend in an elongated manner in the direction of arrangement of the tubes 26. The direction of arrangement of the tubes 26 is a left-right or lateral direction shown in FIGS. 2 and 3, and orthogonal to the direction of air flow "A".

Both the upper and lower ends of the tube 26 of the first heat exchanger 16 are inserted into the tanks 22 and 23 on both the upper and lower sides of the first heat exchanger 16. The tanks 22 and 23 have tube engagement holes (not shown) for connection. Both the upper and lower ends of the tube 26 are in communication with the internal spaces of the tanks 22 and 23.

Likewise, both the upper and lower ends of the tube 26 of the second heat exchanger 17 are inserted into the tanks 24 and 25 on both the upper and lower sides of the second heat exchanger 17. The tanks 24 and 25 have tube engagement holes (not shown) for connection. Both the upper and lower ends of the tube 26 are in communication with the internal spaces of the tanks 24 and 25.

Thus, the tanks 22, 23, 24, and 25 on both upper and lower sides of the tubes 26 serve to distribute the refrigerant flow among the respective tubes 26 of the first and second heat exchangers 16 and 17, and to collect the refrigerant flowing from the tubes 26.

In the present embodiment, the two upper tanks 22 and 24 are divided into a tube side (bottom side) half-split member 28 extending in the tank longitudinal direction (in a tube arrangement direction), and an anti tube side (upper surface side) half-split member 29. The two half-split members 28 and 29 are combined and bonded integrally to each other, and thereby two cylindrical shapes extending in the tank longitudinal direction (i.e., in the tube arrangement direction) are formed in parallel to be arranged in the air flow direction "A". The tank end of the two cylindrical shapes in the longitudinal direction (the right end shown in FIG. 3) is closed with a cap 30 thereby to constitute the two tank portions 22 and 24.

Although not shown, the two lower tanks 23 and 25 are also constructed of a tube side split member, an anti tube side split member, and a cap, like the two upper tanks 22 and 24.

Specific material for components of the evaporator 15, including the tanks 22 to 25, the tube 26, the fin 27, and the like is preferably aluminum, which is metal having excellent thermal conductivity and brazing characteristics. The respective components are formed using the aluminum material, so that the entire structure of the evaporator 15 can be integrally brazed and assembled.

The connection block 31 and the intervening plate 32 constituting the connection portion of the refrigerant passages shown in FIGS. 2 and 3 are formed by the aluminum material, like the evaporator component. As shown in FIG. 3, the connection block 31 is brazed and fixed to one end side of the evaporator 15 in the longitudinal direction of the upper tank portions 22 and 24 via the intervening plate 32. The connection block 31 includes one refrigerant inlet 33 and one refrigerant outlet 34 in the integrated evaporator unit 21.

As shown in FIG. 3, the connection block 31 is provided with one refrigerant inlet 33 and one refrigerant outlet 34, so that the connection block 31 and the intervening plate 32 work in cooperation with each other thereby to form the one refrigerant passage in the integrated evaporator unit 21 to be described later.

The intervening plate 32 is formed such that a communication hole 14 serving as the first flow amount adjustment mechanism communicates the refrigerant passage on the connection block 31 side with the internal space of the upper tank 22. The communication hole 14 is formed in an orifice shape whose flow path sectional area is reduced with respect to the refrigerant passage on the connection block 31 side.

The communication hole 14 serves as the first flow amount adjustment portion. Instead of forming the communication hole 14, a capillary tube may be integrally brazed to a position of the hole to form the first flow amount adjustment portion.

A hole 32*a* in which the second flow amount adjustment portion 19 penetrates is formed above the communication hole 14 in the intervening plate 32. In the present embodiment, the second flow amount adjustment portion 19 is integrated with an introduction pipe 42 to be described later, and one end of the introduction pipe 42 in the longitudinal direction (left end shown in FIG. 3) constitutes the second flow amount adjustment portion 19.

A concave groove 35 is formed on a surface of the connection block 31 on the intervening plate 32 side. A refrigerant inlet 33 is provided in communication with one end of the concave groove 35 (lower end shown in FIG. 3). The first and second flow amount adjustment portions 14 and 19 are in communication with the other end (upper end shown in FIG. 3) of the concave groove 35.

A concave groove 36 is formed in the intervening plate 32 to be opposed to the concave groove 35 of the connection block 31. The combination of both the concave grooves 35 and 36 increases the sectional area of the refrigerant passage.

A main passage 37 is formed by a passage part directed toward the first flow amount adjustment portion 14 in the refrigerant passage formed by the concave groove 35 of the connection block 31. Thus, the first flow amount adjustment portion 14 is provided to be in communication with the main passage 37.

The bypass passage 18 is formed by a passage part provided on the downstream side from a position opposed to the first flow amount adjustment portion 14 in the refrigerant passage formed by the concave groove 35. Thus, the second flow amount adjustment portion 19 is provided to be in communication with the bypass passage 18.

The intervening plate 32 has an opening 38 opened at a part opposed to a refrigerant outlet 34 of the connection block 31 and one side of the upper tank 24 in the longitudinal direction. The opening 38 is provided to be in communication with the refrigerant outlet 34.

A partition plate 39 is a member disposed substantially at the center of the upper tank 22 in the longitudinal direction and brazed to an inner wall surface of the upper tank 22. The partition plate 39 is configured to partition the internal space of the upper tank 24 into two spaces of the tank in the tank longitudinal direction, namely, a left space 40 and a right space 41.

An introduction pipe 42 is provided over the entire area of the left space 40 in the tank longitudinal direction. One end 19 of the introduction pipe 42 is inserted into the hole 32*a* of the intervening plate 32 to be brazed and fixed to the intervening plate 32. Thus, the one end 19 of the introduction pipe 42 protrudes into the main passage 37 of the connection block 31 through the hole 32*a* of the intervening plate 32 to be in direct communication with the inside of the main passage 37.

The one end 19 of the introduction pipe 42 is formed in an orifice shape with a smaller sectional area of the flow path than those of other parts of the introduction pipe 42. Thus, the one end 19 of the introduction pipe 42 reduces the flow path sectional area as compared to that of the main passage 37 in the connection block 31, and thus serves as the second flow amount adjustment portion. Alternatively, the second flow amount adjustment portion may be constructed by forming the entire introduction pipe 42 using a capillary tube having a small diameter, instead of forming the passage-reduced end 19 of the introduction pipe 42 in the orifice shape.

The other end of the introduction pipe 42 in the tank longitudinal direction is inserted into a hole 39*a* formed in the partition plate 39, and brazed and fixed to the partition plate 39. Although not shown, the other end of the introduction pipe 42 in the tank longitudinal direction protrudes into the right space 41 of the upper tank 22 through the hole 39*a* of the partition plate 39 to be in direction communication with the inside of the right space 41.

A partition plate 43 is disposed substantially at the center area of the internal space of the upper tank 24 in the tank longitudinal direction. The partition plate 43 partitions the internal space of the upper tank 22 into two spaces in the tank longitudinal direction, namely, a left space 44 and a right space 45.

The right space 45 of the upper tank 24 is a refrigerant distribution space and is provided to be in communication with the right space 41 of the upper tank 22 via a communication hole (not shown). A plurality of communication holes may be formed along the tank longitudinal direction so that the right space 45 of the upper tank 24 communicates with the right space 41 of the upper tank 22 via the plurality of communication holes. The right space 41 is a refrigerant collection space in which the refrigerant from the tubes 26 collects. Alternatively, only one elongated communication hole extending in the tank longitudinal direction may be formed so that the right space 45 of the upper tank 24 communicates with the right space 41 of the upper tank 22 via the elongated communication hole.

As shown in FIG. 3, two screw holes 46 are formed in the connection block 31 at intermediate parts between the refrigerant inlet 33 and the refrigerant outlet 34 on a side (outer side) opposite to the tanks 22 and 24. The screw holes 46 can be used to screw and connect the components of the refrigeration cycle device. For example, the thermal expansion valve 13 can be connected to the connection block 31 by using the screw holes 46.

In the present embodiment, the connection block 31, the intervening plate 32, the introduction pipe 42, and the partition plates 39 and 43 are integrally brazed to the evaporator 15, and thus are made of aluminum material, like components of the evaporator including the tanks 22 to 25, the tubes 26, the fins 27, and the like.

The refrigerant flow paths of the entire integrated evaporator unit 21 structured as mentioned above will be specifically described below with reference to FIG. 2. The refrigerant inlet 33 of the connection block 31 is branched into the main passage 37 and the bypass passage 18.

The refrigerant in the main passage 37 of the connection block 31, first, has a flow amount adjusted by the first flow amount adjustment portion (communication hole) 14, and flows into the left space 40 of the upper tank 22 as indicated by the arrow "a".

The low-pressure refrigerant flowing into the left space 40 flows downwardly through the tubes 26 in the left portion of the first heat exchanger 16 positioned on the downstream air side as indicated by the arrow "b" to flow into the left portion of the lower tank 23. Since no partition plate is provided in the lower tank 23, the refrigerant moves from the left portion of the lower tank 15*c* into the right portion thereof as indicated by the arrow "c".

The refrigerant in the right portion of the lower tank 23 flows upwardly through the tubes 26 in the right portion of the first heat exchanger 16 as indicated by the arrow "d" to flow into the right space 41 of the upper tank 22.

On the other hand, the refrigerant in the bypass passage 18 has a flow amount adjusted by the introduction pipe 42, which is integrally constructed with the second flow amount adjustment portion 19, as indicated by the arrow "e" to flow into the right space 41 of the upper tank 22.

Then, the refrigerant passing through the first heat exchanger 16 as indicated by the arrow "d" and the refrigerant passing through the introduction pipe 42 as indicated by the arrow "f" are joined in the right space 41, and the joined refrigerant flows into the right space 45 of the upper tank 24 through a communication hole (not shown) as indicated by the arrow "g".

The refrigerant in the right space 45 is distributed into the tubes 26 in the right portion of the second heat exchanger 17 positioned on the upstream air side to flow downwardly through the tubes 26 as indicated by the arrow "h" and then to flow into the right portion of the lower tank 25. Since no partition plate is provided in the lower tank 25, the refrigerant moves from the right portion of the lower tank 25 toward the left portion thereof as indicated by the arrow "i".

The refrigerant in the left portion of the lower tank 25 flows upwardly through the tubes 26 in the left portion of the second heat exchanger 17 disposed on the upstream air side as indicated by the arrow "j", and then flows into the left space 44 of the upper tank 24. Further, the refrigerant therefrom flows into the refrigerant outlet 34 of the connection block 31 as indicated by the arrow "k".

The integrated evaporator unit 21 has the refrigerant flow path structure described above. Accordingly, the entire integrated evaporator unit 21 requires only one refrigerant inlet 33 and only one refrigerant outlet 34 provided in the connection block 31.

Next, the operation of the above-mentioned structure will be described below. When the compressor 11 is driven by the vehicle engine, the high-temperature and high-pressure refrigerant compressed and discharged by the compressor 11 flows into the radiator 12. The high-temperature refrigerant is cooled and condensed by the outside air in the radiator 12. The high-pressure refrigerant flowing from the radiator 12 flows into the liquid receiver 12*a*, in which the refrigerant is separated into gas and liquid phases. The liquid refrigerant is guided from the liquid receiver 12*a* to pass through the thermal expansion valve 13.

The expansion valve 13 is configured to decompress the high-pressure refrigerant by adjusting the degree of opening of the valve so as to adjust the refrigerant flow amount, such that the superheat degree of refrigerant at the outlet of the evaporator 15 becomes a predetermined value. Therefore, the superheat degree of refrigerant to be drawn into the compressor 11 approaches to a predetermined degree. The refrigerant having passed through the expansion valve 13 becomes in a low-pressure refrigerant, and flows into the one refrigerant inlet 33 provided in the connection block 31 of the integrated evaporator unit 21.

The refrigerant flow is divided into a refrigerant stream directed from the main passage 37 of the connection block 31 toward the first flow amount adjustment portion 14, and a refrigerant stream directed from the bypass passage 18 of the connection block 31 toward the second flow amount adjustment portion 19.

The low-pressure refrigerant whose flow amount is adjusted by the first flow amount adjustment portion 14 flows in the refrigerant flow paths of the first heat exchanger 16 as indicated by the arrows "b" to "d" of FIG. 2. During this time, in the first heat exchanger 16, the low-pressure refrigerant having a low temperature absorbs heat from the blown air having passed through the second heat exchanger 17 as indicated by the arrow "A", so as to be evaporated.

On the other hand, the refrigerant stream into the bypass passage 18 has a flow amount adjusted by the second flow amount adjustment portion 19, and is then joined into the gas-phase refrigerant having passed through the first heat exchanger 16 at the joint portion Z.

The joined gas-liquid two-phase refrigerant flows through the refrigerant flow paths in the second heat exchanger 17 as indicated by the arrows "h" to "j" shown in FIG. 2. During this time, in the second heat exchanger 17, the low-temperature and low-pressure gas-liquid two-phase refrigerant absorbs heat from the blown air indicated by the arrow "A", so as to be evaporated. The gas-phase refrigerant after evaporation flows out of the one refrigerant outlet 34, and is drawn into the compressor 11 to be compressed again.

As mentioned above, in the present embodiment, the first and second heat exchangers 16 and 17 can simultaneously exhibit cooling performance. Thus, the air cooled by both the first and second heat exchangers 16 and 17 is blown into a space to be cooled, thereby enabling refrigerating (cooling) of the space.

At that time, the refrigerant having a large dryness X after being subjected to heat exchange at the first heat exchanger 16 and the refrigerant having a small dryness X after bypassing the first heat exchanger 16 are mixed to flow into the second heat exchanger 17. The dryness X of the refrigerant in the refrigerant upstream side portion (right portion) of the second heat exchanger 17 can be made smaller than the dryness X of the refrigerant in the refrigerant downstream side portion (left portion) of the first heat exchanger 16.

Because the first and second flow amount adjustment portions 14 and 19 adjust the flow amount of refrigerant flowing through the first heat exchanger 16 and the flow amount of refrigerant flowing through the bypass passage 18, portions in which the dryness X of refrigerant is in a range between 0.6 and 0.9 can exist in the first and second heat exchangers 16 and 17.

Thus, a plurality of portions in which the dryness X of refrigerant is in a range between 0.6 and 0.9 can be provided so as to improve the heat exchange property in the evaporator 15.

Figure 4:
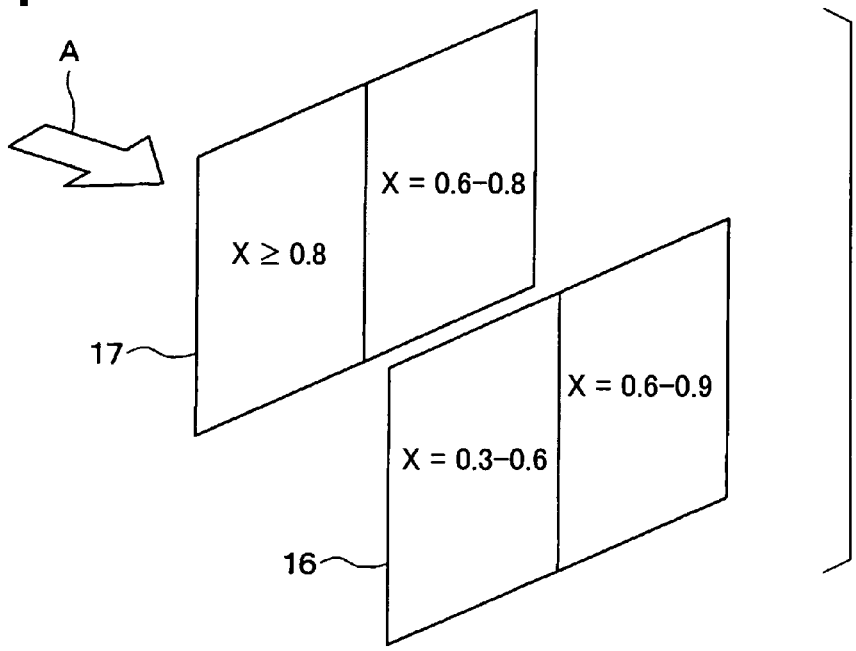
FIG. 4 is a schematic diagram showing dryness of refrigerant at plural portions in the integrated evaporator unit according to the first embodiment.

FIG. 4 shows a specific example of the dryness X of refrigerant at the first and second heat exchangers 16 and 17 in the present embodiment. In the specific example, the first and second flow amount adjustment portions 14 and 19 adjust the flow amount of refrigerant flowing through the first heat exchanger 16 and the flow amount of refrigerant flowing through the bypass passage 18 in the following way. That is, the dryness X of the refrigerant in the left portion (i.e., the refrigerant upstream side portion) of the first heat exchanger 16 is in a range of 0.3 to 0.6. The dryness X of the refrigerant in the right portion (i.e., the refrigerant downstream side portion) of the first heat exchanger 16 is in a range of 0.6 to 0.9. The dryness X of refrigerant in the right portion (i.e., the refrigerant upstream side portion) of the second heat exchanger 17 is in a range of 0.6 to 0.8. The dryness X of refrigerant in the left portion (i.e., the refrigerant downstream side portion) of the second heat exchanger 17 is equal to or larger than 0.8.

In the present embodiment, because the second heat exchanger 17 is disposed on the refrigerant downstream side of the first heat exchanger 16, the second heat exchanger 17 serves as a last heat exchanging portion (most downstream heat exchanging portion) in the entire evaporator 15.

The second heat exchanger 17 including the last heat exchanging portion is disposed on the upstream side of the air flow "A" of the first heat exchanger 16. When the last heat exchanging portion has a superheat degree, the evaporator integrated unit 21 can ensure both of a difference between a refrigeration evaporation temperature of the first heat exchanger 16 and the temperature of the blown air, and a difference between a refrigeration evaporation temperature of the second heat exchanger 17 and the temperature of the blown air.

Accordingly, both first and second heat exchangers 16 and 17 can effectively exhibit cooling capability. Thus, a combination of the first and second heat exchangers 16 and 17 can effectively improve the cooling performance for cooling a common space to be cooled.

In the present embodiment, a portion of the first heat exchanger 16 on the most downstream side of the refrigerant flow (the rightmost portion) and a portion of the second heat exchanger 17 on the most downstream side of the refrigerant flow (the leftmost portion) are arranged at different positions so as not to be superimposed on each other as viewed in the direction parallel to the air flow "A". Thus, the point of the first heat exchanger 16 having the largest dryness X of the refrigerant can be prevented from being superimposed on the point of the second heat exchanger 17 having the largest dryness X of the refrigerant as viewed in the direction parallel to the air flow "A".

Thus, the distribution of dryness X of the refrigerant can be made uniform over the entire evaporator 15, thereby equalizing the temperature distribution of blown air in the evaporator 15.

In the present embodiment, a part of refrigerant circulating through the refrigerant cycle flows while bypassing the first heat exchanger 16, so that the flow amount of refrigerant flowing through the first heat exchanger 16 can be lessened as compared to a case where all refrigerant circulating through the refrigerant cycle flows through the first heat exchanger 16.

Thus, the mass flow velocity per sectional area of a refrigerant flow path of the first heat exchanger 16 ($kg/m^2s$) can be made small, resulting in a small loss in refrigerant pressure at the first heat exchanger 16.

On the other hand, because all refrigerant circulating through the refrigerant cycle flows in the second heat exchanger 17 disposed on the downstream side of the join portion Z, the flow amount of refrigerant flowing through the second heat exchanger 17 is larger than that of refrigerant flowing through the first heat exchanger 16.

From the above-mentioned viewpoint, the sectional area of the refrigerant flow path in the second heat exchanger 17 is set larger than that of the refrigerant flow path in the first heat exchanger 16, thereby resulting in a small loss in pressure of the refrigerant at the second heat exchanger 17. Specifically, the passage sectional area of the tube 26 of the second heat exchanger 17 may be set larger than that of the tube 26 of the first heat exchanger 16. Alternatively, the number of the tubes 26 of the second heat exchanger 17 may be set larger than that of the tubes 26 of the first heat exchanger 16.

The detailed studies by the inventors have found that the diameter of the refrigerant flow path of each of the first and second flow amount adjustment portion 14 and 19 may be equal to or less than 4 mm in order to exhibit a good flow amount adjustment function performed by the first and second flow amount adjustment portions 14 and 19.

According to the present embodiment, the evaporator 15, the first and second flow amount adjustment portions 14 and 19, and the connection block 31 are assembled as one integrated structure shown in FIG. 3, that is, as the integrated evaporator unit 21. Thus, the entire integrated evaporator unit 21 only requires the one refrigerant inlet 33 and the one refrigerant outlet 34.

As a result, in mounting the refrigeration cycle device 10 on a vehicle, the one refrigerant inlet 33 is connected to the outlet side of the expansion valve 13, and the one refrigerant outlet 34 is connected to the suction side of the compressor 11 in the entire integrated evaporator unit 21 cooperating therein various components 15, 14, 19, and 31, so as to terminate a piping connection work.

At the same time, the first and second flow amount adjustment portions 14 and 19 are accommodated in the tank 22 of the integrated evaporator unit 21, so that the internal space of the tank of the evaporator 15 can be effectively used as a mounting space for the first and second flow amount adjustment portions 14 and 19, resulting in reduction in mounting space of the integrated evaporator unit 21 including the first and second flow amount adjustment portions 14 and 19 and the evaporator 15.

On the other hand, a separate structure may be supposed to include the evaporator 15 and the first and second flow amount adjustment portions 14 and 19 respectively formed as independent components. The components are independently fixed to a chassis part, such as a vehicle body, and bonded together via piping. Thus, the integrated evaporator unit 21 of the present embodiment can greatly improve the mounting performance of the refrigeration cycle device 10 on the vehicle as compared to a case of using the above-mentioned separate structure. Further, the integrated evaporator unit 21 can achieve reduction in the number of the cycle components, and in cost as compared to the case of using the separate structure.

The integrated evaporator unit 21 can decrease the length of connection passages among various components 15, 14, 19, and 31 to a small level, thus reducing a loss in pressure at the refrigerant flow path, while effectively reducing heat exchange between the low-pressure refrigerant and peripheral atmosphere. Thus, the cooling capability of the evaporator 15 can be improved.

The refrigerant passages 18 and 37 are formed in one connection block 31, so that one connection block 31 can also serves as a refrigerant passage forming member, and thereby it can reduce the cost and size of the cycle.

(Second Embodiment)

Figure 5:
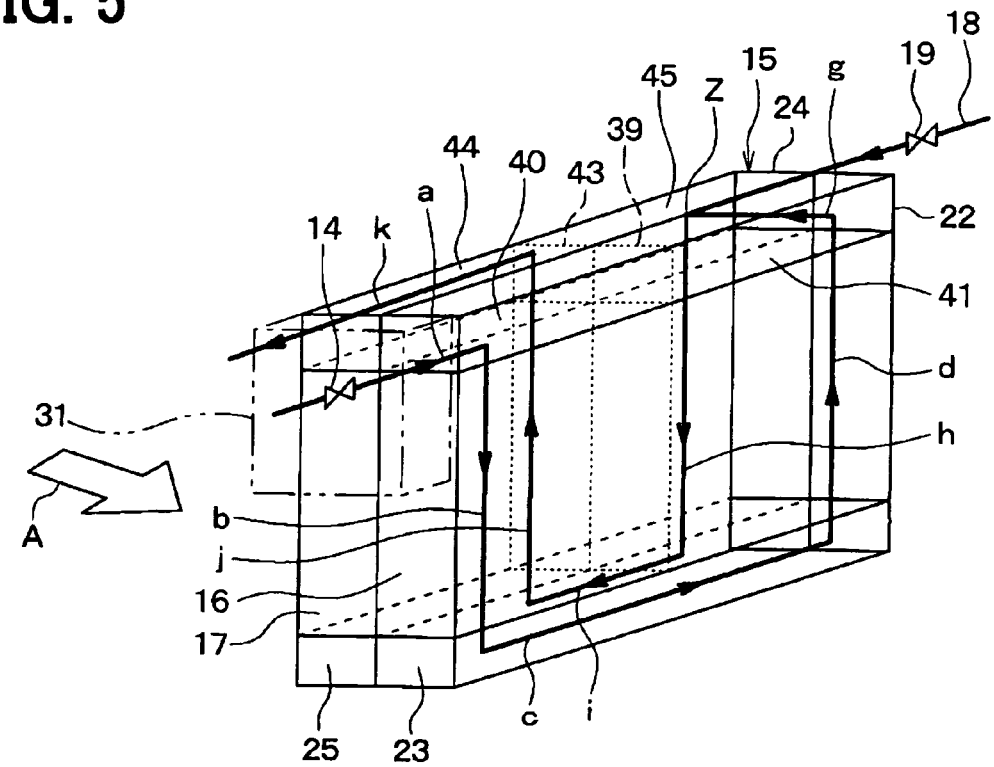
FIG. 5 is a schematic perspective view showing an integrated evaporator unit according to a second embodiment of the present invention.

A second embodiment of the invention will be now described with reference to FIG. 5. The second embodiment differs from the first embodiment in the refrigerant flow path structure of the evaporator 15. Specifically, as shown in FIG. 5, a bypass passage 18 is formed outside the connection block 31, thus allowing the refrigerant passing through the second flow amount adjustment portion 19 to directly flow into the right end of the upper tank 24.

In the present embodiment, the refrigerant flowing into the left space 40 of the upper tank 22 through the first flow amount adjustment portion 14 as indicated by the arrow "a" flows downwardly through the left portion of the first heat exchanger 16 as indicated by the arrow "b". Thereafter, the refrigerant flows from the left portion to the right portion of the first heat exchanger 16 as indicated by the arrow "c", and then flows upwardly through the right portion of the first heat exchanger 16 as indicated by the arrow "d" to flow into the right space 41 of the right tank 22.

The refrigerant flowing into the right space 41 of the upper tank 22 flows into the right space 45 of the upper tank 24 as indicated by the arrow "g". After being joined with the refrigerant having passed through the second flow amount adjustment portion 19, the refrigerant flows downwardly through the right portion of the second heat exchanger 17 as indicated by the arrow "h". Then, the refrigerant flows through the lower tank 25 from the right portion thereof to the left portion thereof as indicated by the arrow "i", and rises through the left portion of the second heat exchanger 17 as indicated by the arrow "j" to flow into the left space 44 of the upper tank 24. The refrigerant then flows out toward the outside of the evaporator 15 as indicated by the arrow "k".

Also, in the present embodiment, the entire evaporator 15 can have two portions in which the dryness X of refrigerant is in a range between 0.6 and 0.9, thereby improving the heat exchange property in the entire evaporator 15.

In the second embodiment, the other parts may be made similar to those of the above-described first embodiment.

(Third Embodiment)

Figure 6:
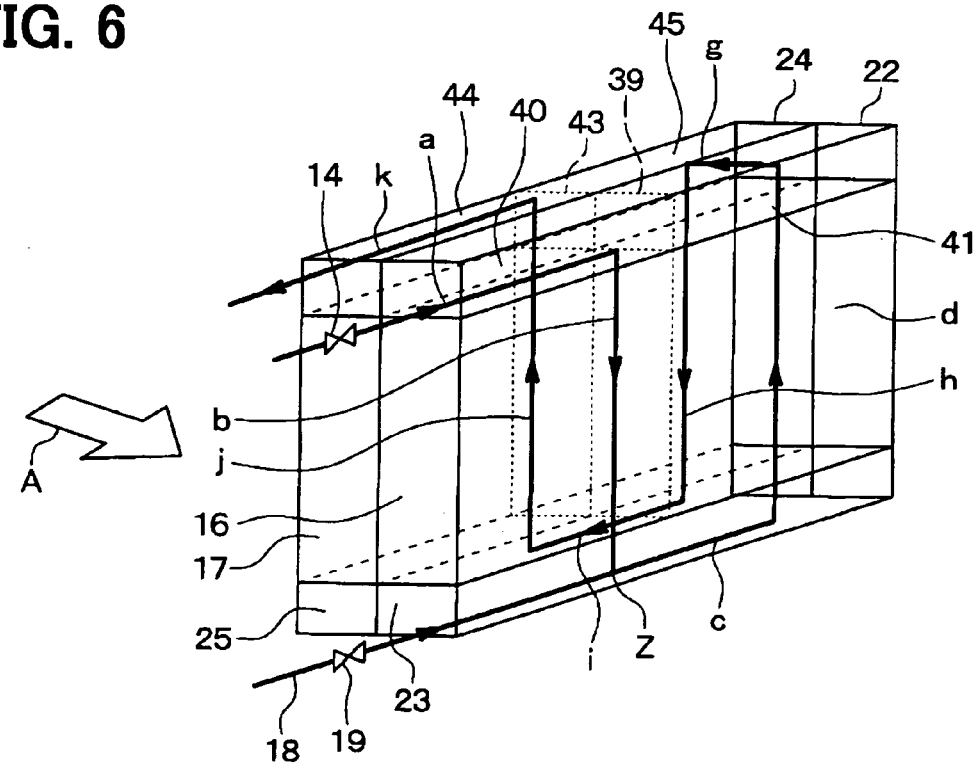
FIG. 6 is a schematic perspective view showing an integrated evaporator unit according to a third embodiment of the present invention.

A third embodiment of the invention will be described with reference to FIG. 6. The third embodiment differs from the second embodiment in the refrigerant flow path structure in the evaporator 15. Specifically, as shown in FIG. 6, the refrigerant having passed through the second flow amount adjustment portion 19 directly flows into the left end of the lower tank 23.

In the present embodiment, the refrigerant flowing into the left space 40 of the upper tank 22 through the first flow amount adjustment portion 14 as indicated by the arrow "a" flows downwardly through the left portion of the first heat exchanger 16 as indicated by the arrow "b" to flow into the left portion of the lower tank 23.

The refrigerant flowing into the left portion of the lower tank 23 is joined with the refrigerant having passed through the second flow amount adjustment portion 19, and then moves through the lower tank 23 from the left side thereof to the right side thereof as indicated by the arrow "c". Thereafter, the refrigerant rises through the right portion of the first heat exchanger 16 as indicated by the arrow "d" to flow into the right space 41 of the upper tank 22.

The refrigerant flowing into the right space 41 of the upper tank 22 flows into the right space 45 of the upper tank 24 as indicated by the arrow "g", and then descends the right portion of the second heat exchanger 17 as indicated by the arrow "h". The refrigerant moves through the lower tank 25 from the right portion thereof to the left portion thereof as indicated by the arrow "i", and then rises through the left portion of the second heat exchanger 17 as indicated by the arrow "j" to flow into the left space 44 of the right tank 24. Then, the refrigerant flows out toward the outside of the evaporator 15 as indicated by the arrow "k".

Also, in the present embodiment, like the second embodiment, the entire evaporator 15 can have two portions in which the dryness X of refrigerant is in a range between 0.6 and 0.9, thereby improving the heat exchange property of the evaporator 15.

In the third embodiment, the other parts may be made similar to those of the above-described first embodiment.

(Fourth Embodiment)

Figure 7:
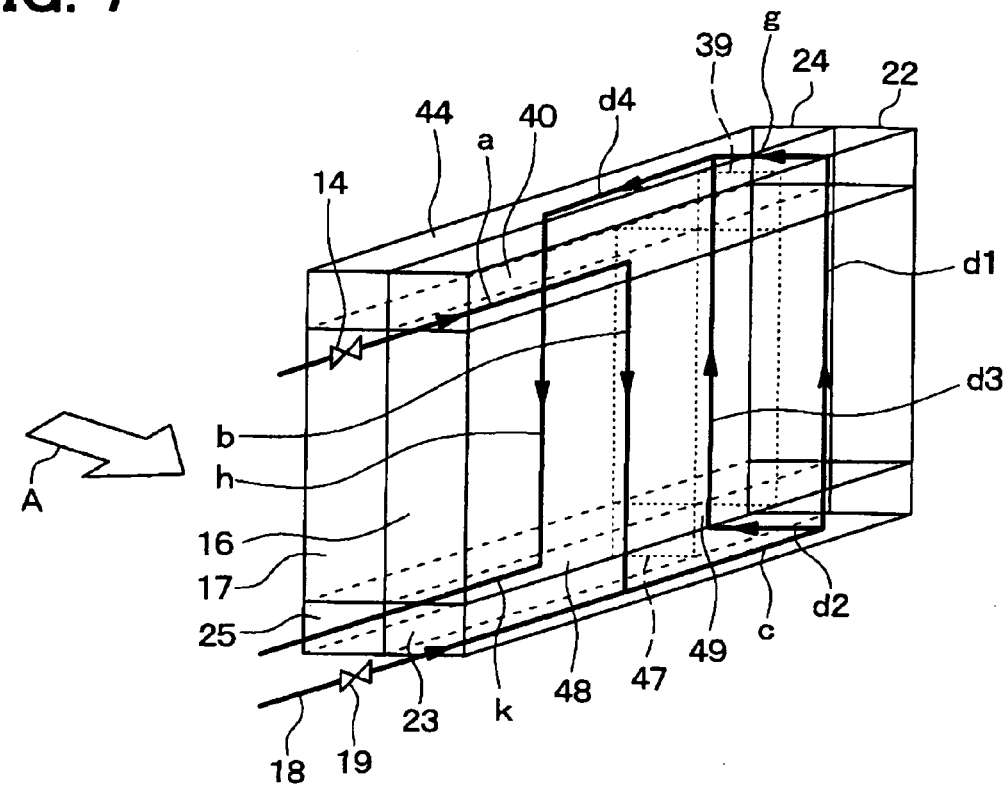
FIG. 7 is a schematic perspective view showing an integrated evaporator unit according to a fourth embodiment of the present invention.

A fourth embodiment of the invention will be described with reference to FIG. 7. The fourth embodiment differs from the third embodiment in the refrigerant flow path structure of the evaporator 15. Specifically, as shown in FIG. 7, a partition plate 47 is disposed at the center of the lower tank 25 in the longitudinal direction to partition the inside of the lower tank 25 into a left space 48 and a right space 49. The right space 49 of the lower tank 25 is configured to be in communication with a right portion of the lower tank 23 via a communication hole not shown. Further, a refrigerant outlet is provided in the left end space 48 of the lower tank 25, and the partition plate 43 for the upper tank 24 is removed.

In the present embodiment, the refrigerant flowing into the left space 40 of the upper tank 22 through the first flow amount adjustment portion 14 as indicated by the arrow "a" descends the left portion of the first heat exchanger 16 as indicated by the arrow "b" to flow into the left portion of the lower tank 23.

The refrigerant flowing into the left portion of the lower tank 23 is merged with the refrigerant having passed through the second flow amount adjustment portion 19, and then moves through the lower tank 23 from the left side thereof to the right side thereof as indicated by the arrow "c". The refrigerant is divided into a refrigerant flow rising through the right portion of the first heat exchanger 16 as indicated by the arrow "d1" and a refrigerant flow flowing into the right space 49 of the lower tank 25 as indicated by the arrow "d2".

The refrigerant rising through the right portion of the first heat exchanger 16 as indicated by the arrow "d1" flows into the right space 41 of the upper tank 22 to flow into the right portion of the upper tank 24 as indicated by the arrow "g".

On the other hand, the refrigerant flowing into the right space 49 of the lower tank 25 as indicated by the arrow "d2" rises through the right portion of the second heat exchanger 17 to flow into the right portion of the upper tank 24 as indicated by the arrow "d3". The refrigerant is merged with the refrigerant having passed through the right portion of the first heat exchanger 16, and then moves through the upper tank 24 from the right side thereof to the left side thereof as indicated by the arrow "d4". Further, the refrigerant descends through the left portion of the second heat exchanger 17 as indicated by the arrow "h" to flow into the left space 48 of the lower tank 25. Then, the refrigerant flows out toward the outside of the evaporator 15 as indicated by the arrow "k".

Also, in the present embodiment, like the third embodiment, the entire evaporator 15 can have two portions in which the dryness X of refrigerant is in a range between 0.6 and 0.9, thereby improving the heat exchange property in the entire evaporator 15.

(Fifth Embodiment)

Figure 8:
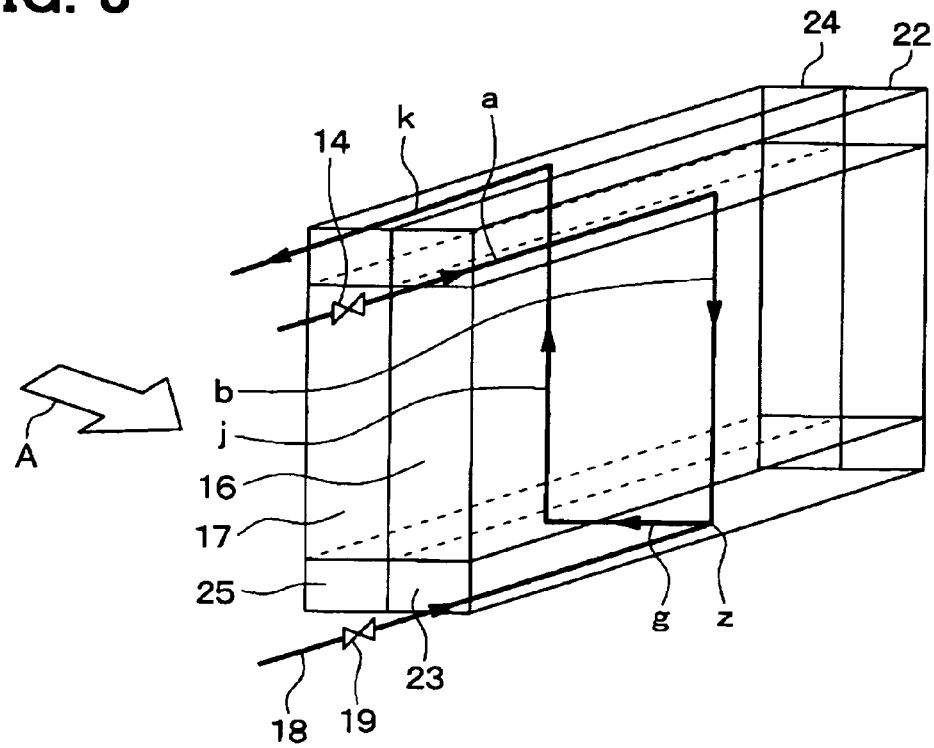
FIG. 8 is a schematic perspective view showing an integrated evaporator unit according to a fifth embodiment of the present invention.

A fifth embodiment of the invention will be now described with reference to FIG. 8. The fifth embodiment differs from the third embodiment in the refrigerant flow path structure of the evaporator 15. Specifically, as shown in FIG. 8, the partition plates 39 and 43 for the upper tanks 22 and 24 are removed, and the communication hole for communicating the upper tank 22 with the upper tank 24 is removed. An internal space of the lower tank 23 is made to be in communication with an internal space of the lower tank 26 via a communication hole (not shown).

In the present embodiment, the refrigerant flowing into the internal space of the upper tank 22 through the first flow amount adjustment portion 14 as indicated by the arrow "a" descends through the first heat exchanger 16 as indicated by the arrow "b" to flow into the lower tank 23.

The refrigerant flowing into the lower tank 23 is joined with the refrigerant flowing into the lower tank 23 through the second flow amount adjustment portion 19, and then flows into the lower tank 25 as indicated by the arrow "g". The refrigerant rises through the second heat exchanger 17 as indicated by the arrow "j" to flow into the upper tank 24, and then flows out toward the outside of the evaporator 15 as indicated by the arrow "k".

Also, in the present embodiment, like the third embodiment, the entire evaporator 15 can have two portions in which the dryness X of refrigerant is in a range between 0.6 and 0.9, thereby improving the heat exchange property in the entire evaporator 15.

(Sixth Embodiment)

Figure 9:
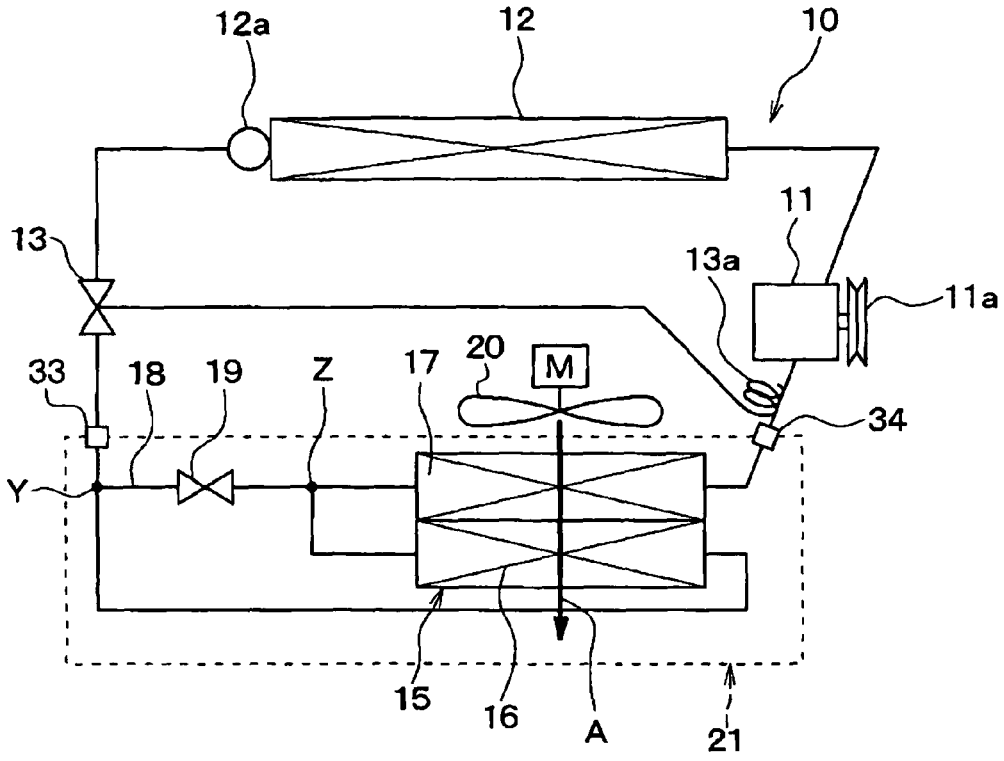
FIG. 9 is a refrigerant circuit diagram showing a refrigeration cycle device according to a sixth embodiment of the present invention.

A sixth embodiment of the invention will be now described with reference to FIG. 9. The sixth embodiment of the invention differs from the first embodiment in that the first flow amount adjustment portion 14 is removed as shown in FIG. 9. That is, the second flow amount adjustment portion 19 is only used as a single flow amount adjustment mechanism.

Thus, the second flow amount adjustment portion 19 adjusts the flow amount of refrigerant in the bypass passage 18. As a result, the flow amount of refrigerant flowing into the first heat exchanger 16 is also adjusted, and thereby the same effect and operation as those of the first embodiment can be obtained. The sixth embodiment is not provided with the first flow amount adjustment portion 14 in the refrigerant cycle of the above-described first embodiment, thereby reducing the cost of the cycle.

(Seventh Embodiment)

In the above-described first to sixth embodiments, the evaporator 15 includes the first and second heat exchangers 16 and 17. In a seventh embodiment of the invention, as shown in FIG. 10, an evaporator 15 includes a third heat exchanger 50 in addition to the first and second heat exchangers 16 and 17.

Figure 10:
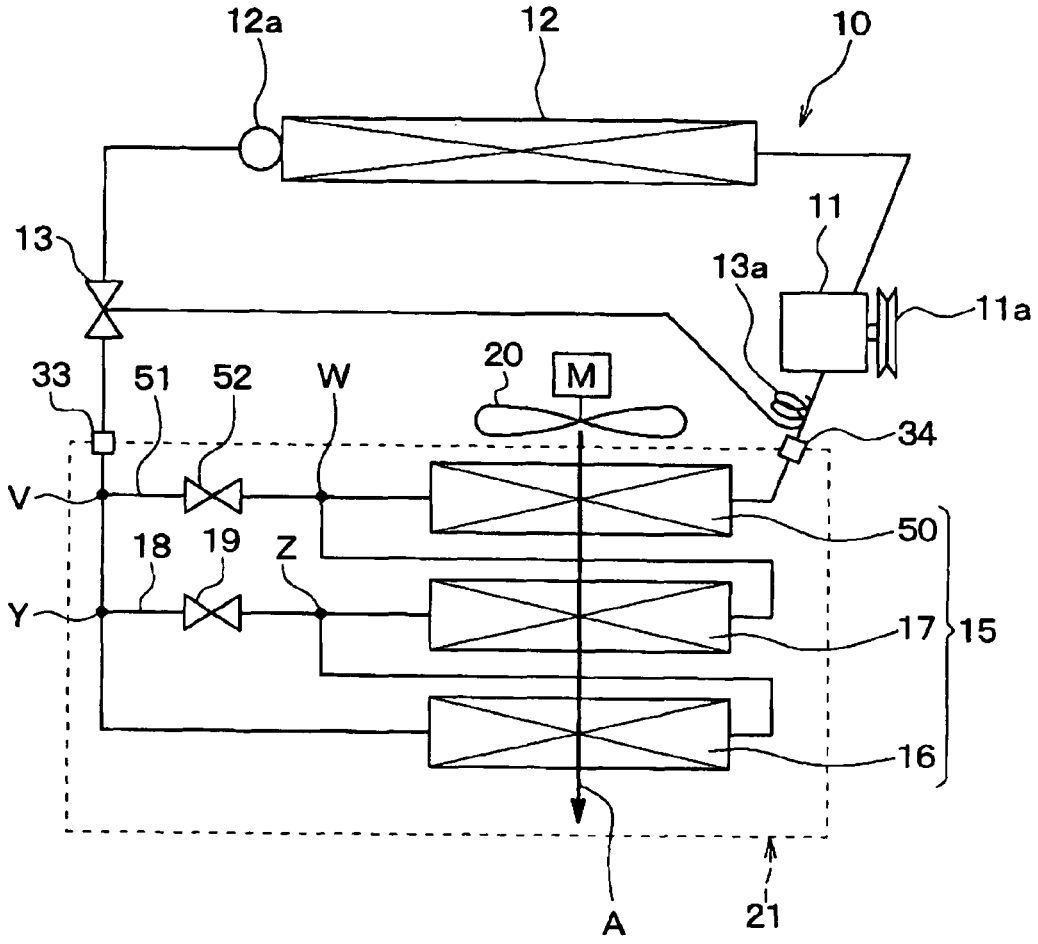
FIG. 10 is a refrigerant circuit diagram showing a refrigeration cycle device according to a seventh embodiment of the present invention.

The example of FIG. 10 differs from the third embodiment in that the third heat exchanger 50 is connected to the outlet side of the second heat exchanger 17, and a second bypass passage 51 for bypassing the first and second heat exchangers 16 and 17 is branched from a branch portion V between the outlet side of the thermal expansion valve 13 and the branch portion Y. Further, the downstream side of the second bypass passage 51 is connected to a portion between the outlet side of the second heat exchanger 17 and the inlet side of the third heat exchanger 50, and a third flow amount adjustment portion 52 is disposed in the second bypass passage 51.

The third flow amount adjustment portion 52 can be constructed of a fixed throttle, specifically, an orifice, or a capillary tube. In FIG. 10, the second bypass passage 51 is branched from the branch portion V and is joined with the main flow from the first and second heat exchangers 16, 17 at a join portion W.

Also, in the present embodiment, the first to third heat exchangers 16, 17, and 50 can have respective portions in which the dryness X of refrigerant is between 0.6 and 0.9, thereby further improving the heat exchange property of the evaporator 15.

(Eighth Embodiment)

In the seventh embodiment, the third heat exchanger 50 is connected to the outlet side of the second heat exchanger 17. However, in an eighth embodiment, a third heat exchanger 50 is connected to the inlet side of the second heat exchanger 17 as shown in FIG. 11.

Figure 11:
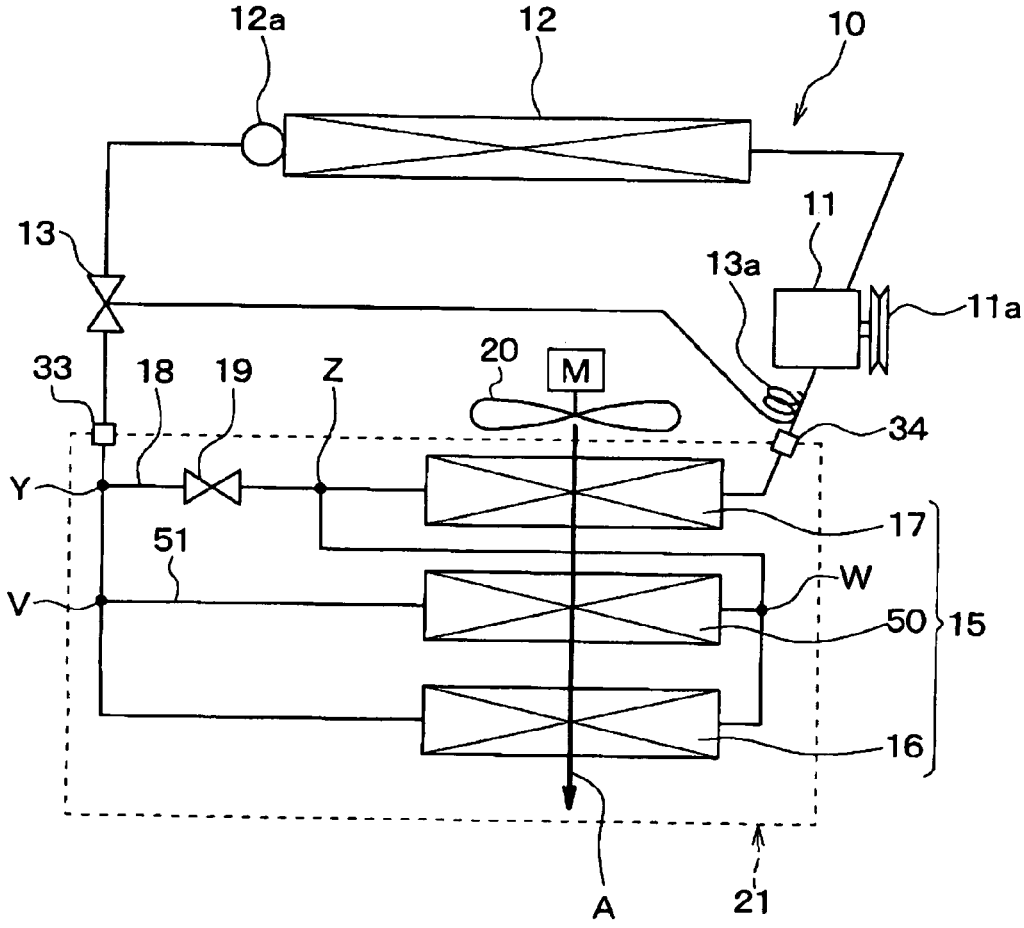
FIG. 11 is a refrigerant circuit diagram showing a refrigeration cycle device according to an eighth embodiment of the present invention.

In the example of FIG. 11, the first heat exchanger 16 and the third heat exchanger 50 are arranged in parallel to the refrigerant flow.

In the present embodiment, only the second flow amount adjustment portion 19 is provided as the flow amount adjustment mechanism, and adapted to adjust the flow amount of refrigerant flowing through the bypass passage 18. As a result, the flow amounts of refrigerant flowing into the first and third heat exchangers 16 and 50 are also adjusted.

Thus, the present embodiment can exhibit the same effect and operation as those in the seventh embodiment.

(Other Embodiments)

The invention is not limited to the embodiments disclosed above, and various modifications can be made to those embodiments as follows.

(1) Although in the first embodiment, the evaporator 15, the first and second flow amount adjustment portions 14 and 19, and the connection block 31 are integrally brazed together so as to integrally assemble respective components of the integrated evaporator unit 21, the components can also be integrally assembled by any one of various types of fixing means, including screwing, caulking, welding, adhesive, and the like, other than the brazing.

(2) Although each of the above-mentioned embodiments has described the vapor-compression subcritical refrigerant cycle using refrigerant whose high-pressure side pressure does not exceed the critical pressure, such as a flon-based or HC-based refrigerant, the invention may be applied to a vapor-compression supercritical refrigerant cycle using refrigerant whose high-pressure side pressure exceeds the critical pressure, such as carbon dioxide ($CO_2$).

In the supercritical refrigerant cycle, because the refrigerant discharged from the compressor 11 only radiates heat at the radiator 12 in a supercritical state without being condensed, the liquid receiver 12*a* disposed on the high-pressure side cannot exhibit effects of separating refrigerant into liquid and gas phases, and of retaining the excessive liquid-phase refrigerant. An accumulator serving as a low-pressure side gas-liquid separator may be disposed on the outlet side of the evaporator 15 in the supercritical cycle, and/or the liquid receiver 12*a* may be omitted.

(3) Although in the above-mentioned embodiment, each of the flow amount adjustment portions 14, 19, and 52 is constructed of the fixed throttle, such as the orifice or capillary tube, the flow amount adjustment portions 14, 19, and 52 may be a variable throttle, such as an electric control valve, whose opening degree (a passage throttle opening degree) is adjustable by an electric actuator. Alternatively, the flow amount adjustment portions 14, 19, and 52 may be constructed of a combination of a fixed throttle and a variable throttle.

(4) Although in the above-mentioned embodiments, the common space to be cooled is cooled by the heat exchangers 16, 17, and 50, different spaces of interest to be cooled may be cooled by using the heat exchangers 16, 17, and 50.

(5) In the first embodiment, the thermal expansion valve 13 and the temperature sensing portion 13*a* are constructed separately from the integrated evaporator unit 21. However, the thermal expansion valve 13 and the temperature sensing portion 13*a* may be integrally assembled to the integrated evaporator unit 21. For example, the thermal expansion valve 13 and the temperature sensing portion 13*a* can be accommodated in the connection block 31 of the integrated evaporator unit 21. In this case, the refrigerant inlet 33 is positioned between the liquid receiver 12*a* and the thermal expansion valve 13, and a refrigerant outlet 34 is positioned between the compressor 11 and a passage part provided with the temperature sensing portion 13*a*.

(6) Although each of the above-mentioned embodiments has described the refrigeration cycle device for a vehicle, the invention is not limited thereto. The invention can also be applied to a fixed refrigeration cycle or the like in the same way.

In the above-described embodiments, when the evaporator unit includes: a first heat exchanger 16 configured to perform heat exchange between refrigerant flowing thereinto from a refrigerant inlet 33 and air; a bypass passage 18 through which the refrigerant flowing from the refrigerant inlet flows while bypassing the first heat exchanger 16; a second heat exchanger 17 configured to perform heat exchange between air and mixed refrigerant in which the refrigerant after passing through the first heat exchanger 16 and the refrigerant having passed through the bypass passage 18 are mixed; and a flow amount adjustment portion (14, 19) configured to adjust a flow amount of the refrigerant flowing through the first heat exchanger 16 and a flow amount of the refrigerant flowing through the bypass passage 18, the other parts can be suitably changed. Even in this case, it is possible for the evaporator unit to have plural portions in which the dryness of the refrigerant is in a range between 0.6 and 0.9. Accordingly, heat exchanging performance can be improved in the entire evaporator unit.

Such changes and modifications are to be understood as being within the scope of the present invention as defined by the appended claims.

What is claimed is:

1. An evaporator unit comprising:

a first heat exchanger configured to perform heat exchange between refrigerant flowing thereinto from a refrigerant inlet and air;

a bypass passage through which the refrigerant flowing from the refrigerant inlet flows while bypassing the first heat exchanger;

a second heat exchanger configured to perform heat exchange between air and mixed refrigerant in which the refrigerant after passing through the first heat exchanger and the refrigerant having passed through the bypass passage are mixed; and a flow amount adjustment portion configured to adjust a flow amount of the refrigerant flowing through the first heat exchanger and a flow amount of the refrigerant flowing through the bypass passage; wherein the flow amount adjustment portion includes a fixed throttle;

the first heat exchanger includes a plurality of tubes for allowing the refrigerant to flow therethrough, and a tank for distributing the refrigerant into the tubes and collecting the refrigerant from the tubes;

the flow amount adjustment portion is disposed in the tank;

an internal space of the tank is partitioned into a distribution space for distributing the refrigerant into the tubes, and a collection space for collecting the refrigerant from the tubes, and the first heat exchanger has a refrigerant outlet side configured to be in communication with an inlet side of the second heat exchanger via the collection space, the evaporator unit further comprising an introduction pipe located in the distribution space to introduce the refrigerant flowing through the bypass passage into the collection space, wherein the flow amount adjustment portion is integrated with the introduction pipe.

2. The evaporator unit according to claim 1, wherein the first heat exchanger is disposed on a downstream air side of the second heat exchanger in an air flow, and the second heat exchanger is disposed on an upstream air side of the first heat exchanger in the air flow.

3. The evaporator unit according to claim 1, wherein a downstream portion of the first heat exchanger on the most downstream side of a refrigerant flow and a downstream portion of the second heat exchanger on the most downstream side of the refrigerant flow are arranged at different positions so as not to be superimposed with each other when being viewed in a direction parallel to an air flow.

4. The evaporator unit according to claim 1, wherein a sectional area of a refrigerant flow path in the second heat exchanger is larger than that of a refrigerant flow path in the first heat exchanger.

5. The evaporator unit according to claim 1, wherein a diameter of a refrigerant flow path in the flow amount adjustment portion is equal to or less than 4 mm.

6. The evaporator unit according to claim 1, further comprising a connection portion configured to have a branch portion between the refrigerant inlet and the bypass passage, and wherein the flow amount adjustment portion is formed in the connection portion.

7. The evaporator unit according to claim 6, wherein the first heat exchanger, the second heat exchanger, and the connection portion are integrally brazed together.

8. The evaporator unit according to claim 1, wherein the tank and the introduction pipe are integrally brazed to each other.

9. The evaporator unit according to claim 1, wherein the second heat exchanger and the first heat exchanger are configured to have respectively portions in which a dryness of the refrigerant is in a range between 0.6 and 0.9.

10. The evaporator unit according to claim 1, wherein the second heat exchanger and the first heat exchanger are configured to have a plurality of portions in which a dryness of the refrigerant is in a range between 0.6 and 0.9.

11. The evaporator unit according to claim 1, wherein the flow amount adjustment portion includes a first portion located between a branch portion of the bypass passage and a refrigerant inlet side of the first heat exchanger to adjust a flow amount of the refrigerant, flowing into the first heat exchanger, and a second portion located in the bypass passage.

12. The evaporator unit according to claim 1, further comprising a third heat exchanger located at an upstream or a downstream side of the second heat exchanger in a refrigerant flow, wherein the first to third heat exchangers are configured to have a plurality of portions in which a dryness of the refrigerant is in a range between 0.6 and 0.9.

* * * * *